United States Patent [19]

Yamanaka

[11] Patent Number: 5,049,467

[45] Date of Patent: Sep. 17, 1991

[54] TONER FOR USE IN THE DEVELOPMENT OF ELECTROSTATIC LATENT IMAGES

[75] Inventor: Schunichiro Yamanaka, Hirakata, Japan

[73] Assignee: Orient Chemical Industries, Ltd., Osaka, Japan

[21] Appl. No.: 471,271

[22] Filed: Jan. 26, 1990

[30] Foreign Application Priority Data

Jan. 30, 1989 [JP] Japan ..... 1-22345

[51] Int. Cl.[5] ..... G03G 9/00

[52] U.S. Cl. ..... 430/110

[58] Field of Search ..... 430/110

[56] References Cited

U.S. PATENT DOCUMENTS

| | | | |
|---|---|---|---|
| 3,855,166 | 12/1974 | Fukuda et al. | 260/28.5 R |
| 4,147,645 | 4/1979 | Lu | 252/62.1 P |
| 4,206,064 | 6/1980 | Kiuchi et al. | 430/106 |
| 4,654,175 | 3/1987 | Lu et al. | 260/501.15 |
| 4,656,112 | 4/1987 | Kawagishi et al. | 430/110 |

FOREIGN PATENT DOCUMENTS

| | | |
|---|---|---|
| 0274039 | 7/1988 | European Pat. Off. . |
| 41-2427 | 7/1966 | Japan . |
| 45-26478 | 3/1970 | Japan . |
| 59-121055 | 7/1984 | Japan . |
| 61-291546 | 12/1986 | Japan . |
| 62-136242 | 6/1987 | Japan . |
| 62-265250 | 11/1987 | Japan . |
| 63-7837 | 1/1988 | Japan . |
| 63-72669 | 4/1988 | Japan . |
| 63-99031 | 4/1988 | Japan . |
| 63-99035 | 4/1988 | Japan . |
| 63-266462 | 11/1988 | Japan . |

OTHER PUBLICATIONS

European Search Report dated May 28, 1990.

A. Zinke et al., Berichte der Deutschen Chemischen Gesellschaft, Zur Kenntnis des Hartungs-prozesses, etc., pp. 1729-1733, Nov. 1941.

C. D. Gutsche et al., J. Am. Chem. Soc. 1981, 103, pp. 3782-3791, (1981), "Calixarenes 4, The Synthesis, Characterization and Properties, etc.".

*Primary Examiner*—Marion E. McCamish

*Assistant Examiner*—S. C. Crossan

*Attorney, Agent, or Firm*—Renner, Otto, Boisselle & Sklar

[57] ABSTRACT

A toner for use in the development of electrostatic latent images containing at least one calix (n) arene compound. The compound is almost colorless, dispersible in the toner resin, and compatible with the toner resin, and does not contain metals, so that the toner obtained has stability against environmental changes and excellent stability on storage. The toner can be used to form images that are clear, the fine lines of which have good reproducibility.

2 Claims, No Drawings

TONER FOR USE IN THE DEVELOPMENT OF ELECTROSTATIC LATENT IMAGES

BACKGROUND OF THE INVENTION

1. Field of the Invention

This invention relates to a toner for use in the development of electrostatic latent images for electrophotographs, electrostatic recording, electrostatic printing, and the like. More particularly, this invention relates to a novel dry toner that contains calix (n) arene as a charge-control agent.

2. Description of the Prior Art

Electrostatic latent images can be made visible by the use of electrostatic attraction to cause the attachment of the toner thereto. As agents used to develop such latent electrostatic images, in addition to wet toners, there are dry toners, which are widely used.

In a system in which a dry toner is used to develop an electrostatic latent image, the most important factor is the static properties of the toner. A number of suggestions have been made concerning the control of the static properties of toner particles. In general, when toner is being made dyes, pigments, and charge-control agents are added as additives.

At present, the following techniques are in use. When the toner is positively charged, the nigrosine dye disclosed in Japanese Patent Publication No. 41-2427 or the quaternary ammonium salt disclosed in U.S. Pat. No. 4,654,175 can be used. When toner is negatively charged, the dye of complex salt containing metal disclosed in Japanese Patent Publication No. 45-26478, etc., can be used.

However, the structure of these charge-control agents is complex and their stability is poor. Therefore, the charge-control agents are degraded or decomposed by mechanical friction or impact, by changes in temperature, humidity, electrical impact, and by irradiation, so that they lose their charge-controlling ability.

In recent years, a variety of charge-control agents to solve these problems have been disclosed, for example, in U.S. Pat. Nos. 4,206,064 and 4,656,112, in which metal complexes of salicylic acid and zinc complexes of aromatic oxycarboxylic acid disclosed can be used.

However, these compounds are colored or contain heavy metals such as chrome, cobalt, copper, zinc, etc., which are unsuitable as toner additives.

Japanese Laid-Open Patent Publication No. 63-266462 discloses toners that contain, for example, compounds known to act as developer, sensitizers, antioxidation agents, or the like to prevent deterioration of the surface-treatment carrier (a phenomenon in which the toner comes to be spent on the surface of the carrier, which damages the static properties) in a binary dry developing agent. As antioxidation agents, there are, for example, alkylated derivatives of compounds such as 2,6-di-tert-butyl-p-cresol, 2,6-di-tert-butyl-4-ethylphenol, and hydroquinones, the alkylated derivatives containing 1 to 5 carbon atoms in the alkyl group; 2,2'-methylene-bis-(4-methyl- 6-tert-butylphenol); and 2,2'-methylene-bis-(4-ethyl-6-tert-butylphenol).

In this way, various suggestions have been made to improve the quality of toners. However, conventional toners are disadvantageous in that the charge control changes with environmental changes such as in the temperature and humidity, the stability of toner is poor when it is preserved for a long period of time, and the static properties of toner are also poor, so charge-control agents that confer strong static properties and that are superior in heat-resistance are needed, so as to be usable in a variety of copying machines.

This invention was accomplished by the discovery of an excellent charge-control agent, calix (n) arene compounds, that overcomes the defects of conventional charge-load agents.

For the making of calix (n) arene, phenol and formaldehyde are the starting materials, and the yield is high when synthesis is done with a concentrated alkali. These compounds have a cylindrical structure that resembles that of cyclodextrin.

In the report of Zinke et al. (*Ber. dtsch. chem. Ges.*, 74, 1792, (1941)) it was found that a substance with a high melting point can be obtained by the reaction of phenol and formaldehyde in the presence of sodium hydroxide. Gutsche et al. have published a detailed report of the preparation of various kinds of calix (n) arene derivatives and of their structures and properties (*J. Am. Chem. Soc.* 103, 3782, (1981)).

Calix (n) arene derivatives may be put to practical use as clathrate compounds in enzyme reaction and catalyzed reactions, or in the transport of metal ions (as disclosed in, for example, Japanese Laid-Open Patent Publication Nos. 61-291546, 62-65250, 63-72669, 63-99031, 63-99035, 62-136242, and 63-7837).

However, it has not been disclosed until now that it is possible to use calix (n) arene compounds as a charge-control agent in electrostatic developing toner.

SUMMARY OF THE INVENTION

The toner for use in the development of electrostatic latent images of this invention, which overcomes the above-discussed and numerous other disadvantages and deficiencies of the prior art, contains at least one calix (n) arene compound with the general formula represented by the following general formula I:

[I]

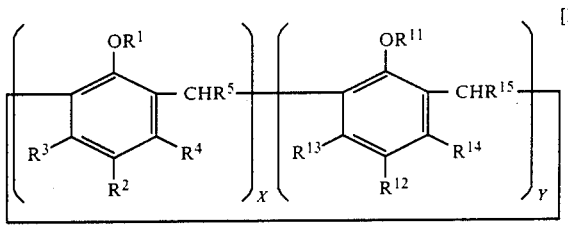

wherein n=X+Y; X and Y are integers, and n=4 to 8; $R^1$ is a hydrogen atom or an alkyl group with 1-5 carbons or else $-(CH_2)_mCOOR^{10}$ (where $R^{10}$ is a hydrogen atom or a lower alkyl group, and m is an integer from 1 to 3); $R^2$ is a hydrogen atom, halogen atom, alkyl group with 1-12 carbons (which can be in the form of branched chains), aralkyl group, $-NO_2$, $-NH_2$, $-N(R^7)_2$ (where $R^7$ is a lower alkyl group), $-SO_3R^8$ (where $R^8$ is a hydrogen atom), phenyl group (which may be a substituted group), or $-Si(CH_3)_3$; $R^3$ and $R^4$ are independently a hydrogen atom, halogen atom, alkyl group with 1-3 carbons, $-NH_2$, or $-N(R^9)_2$ (where $R^9$ is a lower alkyl group); $R^5$ is a hydrogen atom or an alkyl group with 1-3 carbons; $R^{11}$ is a hydrogen atom, an alkyl group with 1-5 carbons, or $-(CH_2)_pCOOR^{20}$ (where $R^{20}$ is a hydrogen atom or a lower alkyl group, and p is an integer from 1 to 3); $R^{12}$ is a hydrogen atom, halogen atom, alkyl group with 1-12 carbons (which can be in the form of branched chains), aralkyl group, $—NO_2$, $—NH_2$, $—N(R^{17})_2$ (where $R^{17}$ is a lower alkyl group), $—SO_3R^{18}$ (where $R^{18}$ is a hydrogen atom), phenyl group (which may be a substituted group), or $—Si(CH_3)_3$; $R^{13}$ and $R^{14}$ are independently a hydrogen atom, halogen atom, alkyl group with 1-3 carbons, $—NH_2$, or $—N(R^{19})_2$ (where $R^{19}$ is a lower alkyl group; and $R^{15}$ is a hydrogen atom or an alkyl group with 1 to 3 carbons.

In a preferred embodiment, 0.1-10 parts by weight of the calix (n) arene compounds represented by general formula I is used per 100 parts by weight of resin.

Thus, the invention described herein makes possible the objectives of (1) providing a toner for use in the development of electrostatic latent images that incorporates calix (n) arene compounds as a charge-control agent, said compounds being almost colorless, containing no metals, and being dispersible in the toner resin and compatible with the toner resin; and (2) providing a toner for use in the development of electrostatic latent images that is used to form images that are clear, the fine lines of which have good reproducibility.

DESCRIPTION OF THE PREFERRED EMBODIMENTS

Calix (n) arene compounds can readily be synthesized by the methods published in *J. Am. Chem. Soc.* 103, 3782-3792 (1981), *Pure & Appl. Chem.* 58, 1523-1528 (1985), *Tetrahedron Lett.* 26, No. 28, 3343-3344 (1985), *Gendai Kagaku* 182, 14-23 (1986), etc.

When calix (n) arene compounds are synthesized by the usual methods, a mixture of cyclic compounds, each of which is composed of n calix arene compounds, and noncyclic compounds is produced. It is possible to obtain the desired calix (n) arene compound I in pure form by crystallization and similar procedures.

The noncyclic compounds are oligomers of the following general formula II:

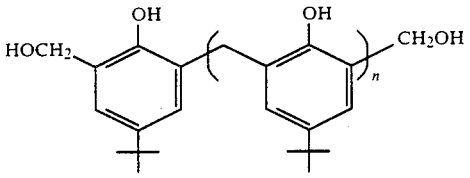

(II)

wherein n=2 to 8. This noncyclic compound has a different structure and properties from those of calix (n) arene compounds, for example, p-tert-butylcalix (n) arene, which is obtained in the form of white crystals or a white powder.

EXAMPLE 1 OF SYNTHESIS

Synthesis of p-tert-butylcalix (8) arene (Compound 1)

First, 27.8 g (0.18 mol) of p-tert-butylphenol and 9.0 g (0.30 mol) of paraformaldehyde were refluxed with the use of 0.4 ml (0.004 mol) of 10 N potassium hydroxide for 4 hours in 150 ml of xylene to cause dehydration, and then cooled and filtered. The precipitate obtained was washed in toluene ether, acetone, and water, in this order, before being dried. Next, recrystallization was done from chloroform, and 22.1 g of white needle-like crystals was obtained (yield, 69.3%).

EXAMPLE 2 OF SYNTHESIS

Synthesis of p-tert-butylcalix (6) arene (Compound 2)

Ten grams (0.07 mol) of p-tert-butylphenol and 4.0 g (0.130 mol) of paraformaldehyde were refluxed for 6 hours in 100 ml of xylene with the use of 6 ml of 5 N rubidium hydroxide to cause dehydration, and then cooled and filtered. The precipitate obtained was separated in a mixture of chloroform and HCl, and the product obtained was recrystallized, giving 7.7 g of a white powder (yield, 71.6%).

EXAMPLES OF COMPOUNDS (1) p-tert-butylcalix (8) arene

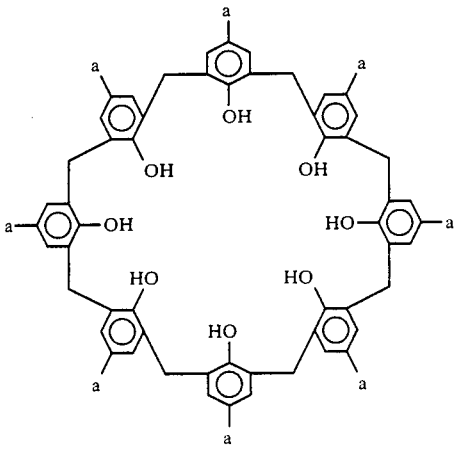

a = $—C(CH_3)_3$ (2) p-tert-butylcalix (6) arene

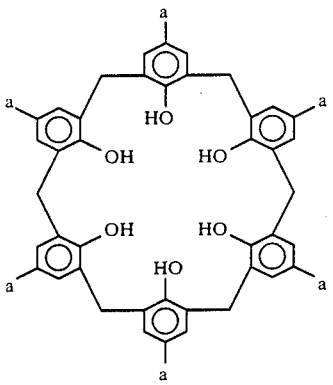

a = $—C(CH_3)_3$ (3) p-tert-butylcalix (4) arene

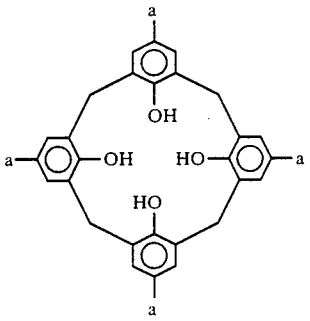

a = $—C(CH_3)_3$ (4) p-tert-amylcalix (6) arene

-continued
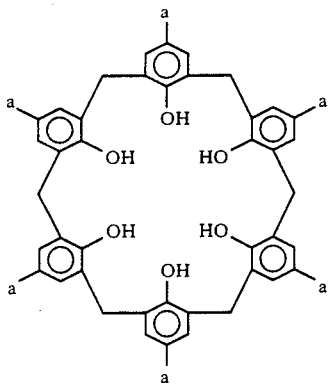
a = $-C(CH_3)_2CH_2CH_3$
(5) p-tert-bytylcalix (5) arene
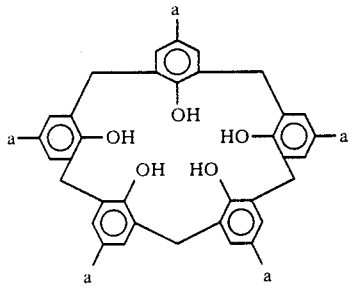
a = $-C(CH_3)_3$
(6) p-tert-butylcalix (7) arene
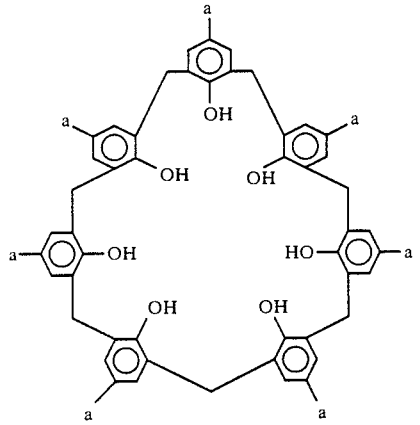
a = $-C(CH_3)_3$
(7) p-n-octylcalix (4) arene
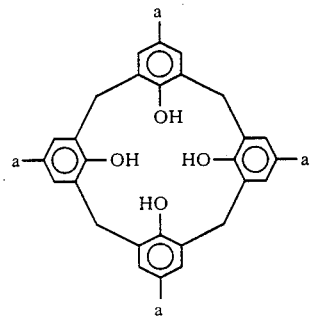
-continued
a = $-CH_2(CH_2)_6CH_3$
(8)
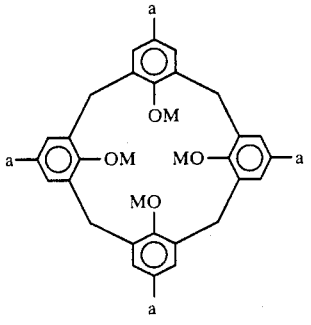
a = $-C(CH_3)_3$
M = $-C_2H_5$
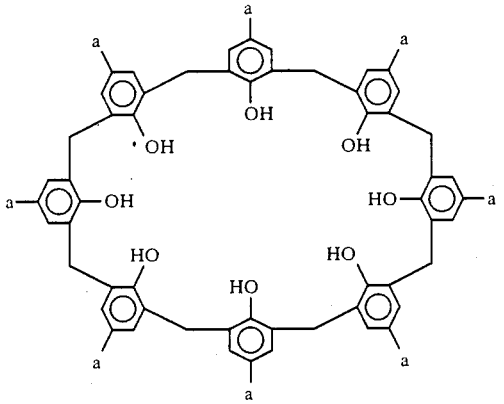
a = Cl
(10)
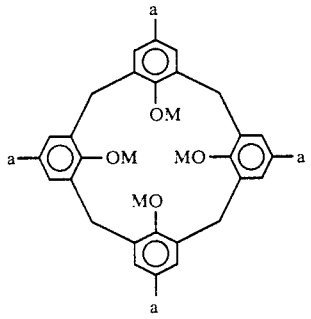
a = $-C_4H_9$
M = $-CH_2COOH$
(11)

-continued

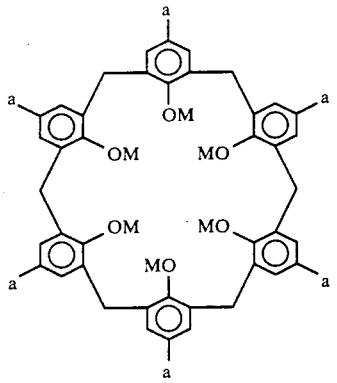

a = $-C(CH_3)_3$
M = $-CH_2CO_2C_2H_5$ (12)

-continued

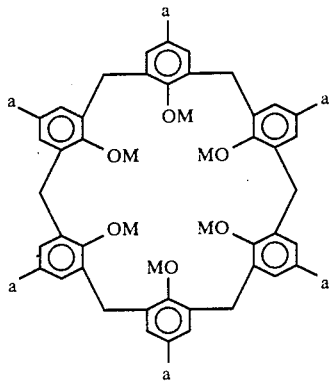

a = Br
M = $-C_2H_5$

TABLE 1

| Example of compounds | n | $R^1$ | $R^2$ | $R^3$ | $R^4$ | $R^5$ | Y |
|---|---|---|---|---|---|---|---|
| 15 | 6 | $-CH_2COOH$ | $-CH_2(CH_2)_3CH_3$ | H | H | H | O |
| 16 | 8 | $-CH_2COOC_2H_5$ | $-C(CH_3)_3$ | H | H | H | O |
| 17 | 8 | $-C_2H_5$ | $-NH_2$ | H | H | H | O |
| 18 | 8 | $-C_3H_7$ | $-SO_3H$ | H | H | H | O |
| 19 | 8 | H | $-NO_2$ | H | H | H | O |
| 20 | 8 | H | $-C(CH_3)_3$ | H | H | $-CH_3$ | O |
| 21 | 8 | H | H | $-CH_3$ | $-CH_3$ | H | O |
| 22 | 8 | H | H | $-N(C_2H_5)_2$ | H | H | O |
| 23 | 6 | H | Cl | Cl | Cl | H | O |
| 24 | 8 | $-CH_2COOH$ | $-Si(CH_3)_3$ | H | H | H | O |
| 25 | 8 | H | $-C(CH_3)_2C_6H_5$ | H | H | H | O |

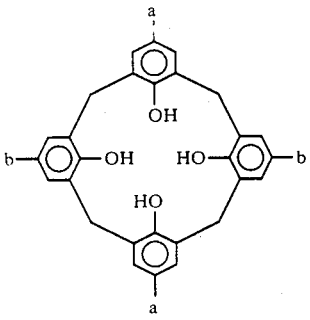

a = $-C(CH_3)_3$
b = $-C_2H_5$ (13)

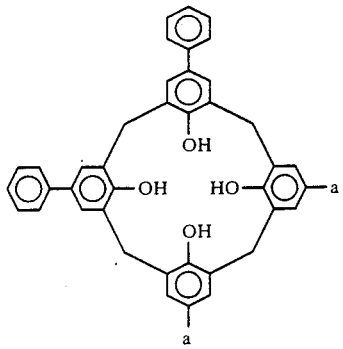

a = $-C(CH_3)_3$ (14)

The toner for use in the development of electrostatic latent images of this invention contains a coloring agent, resin, and a charge-control agent, and can contain conductive particles, agents to improve flowability, agents to prevent peeling of the image, and other additives, to improve the quality of the toner. Per 100 parts by weight of resin, 0.1–10 parts by weight of calix (n) arene compound can be used, and 0.5–5 parts by weight is preferable.

As the resin mentioned above, any well-known resin can be used, such as, for example, styrene resin, styrene-acryl resin, styrene-butadiene resin, styrenemaleic resin, styrene-vinyl methyl ether resin, phenol resin, epoxy resin, polyester, paraffin wax, etc.; these resins can be used alone or in mixtures.

As the coloring agent mentioned above, any of the many well-known dyes and pigments may be used, but for toner for use in making colored copies, those particularly suitable are carbon black, nigrosine dye, benzidine yellow, Hansa yellow, Rhodamine 6G lake, Quinacridone, rose bengal, copper phthalocyanine blue, copper phthalocyanine green, and other such phthalocyanine dyes and pigments, ultramarine blue, anthraquinone dyes, and all kinds of dyes soluble in organic solvents.

The toner of this invention generally is mixed with a carrier to provide a two-component system of developing agent, but it is also possible, of course, that the toner is of a one-component system developing agent.

As carriers that can be used in this invention, any known carriers can be used. For example, there are iron powder, nickel powder, ferrite powder, glass beads having particle diameter of about 50 to 200 μm, and coated particles obtained by coating the above-mentioned powder particles and beads with a resin; the resin includes acrylate copolymer, styrene-acrylate copolymer, styrene-methacrylate copolymer, silicone resins, polyamide resins, fluorinated ethylene resins, etc.

In the production of the toner of this invention, if a magnetic carrier made of iron powder, nickel powder, ferrite powder or the like is added and dispersed in the toner, then a developing agent of one-component system is obtained. Development can be carried out using the developing agent by the contact development method, projection development method and the like.

Below, this invention will be described in detail with reference to examples.

In the examples below, the word "parts" means "parts by weight".

EXAMPLE 1

| | |
|---|---|
| Copolymer of styrene and acrylic monomer (Sanyo Kasei Co., HIMER SMB600) | 100 parts |
| Carbon black (Mitsubishi Kasei Co., MA-100) | 5 parts |
| Compound 1 | 1 part |

The above components were first mixed in a high-speed mixer to homogeneity. Then the mixture was melted in an extruder, kneaded, cooled, and pulverized in an oscillating mill. The powder obtained was finely powdered in an airjet to which a classifier was attached. A black toner with particle diameter of 10–20 μm was obtained.

To 5 parts of the toner obtained, 95 parts of iron-powder carrier (Nippon Teppun Co., TEFV 200/300) was added to give developer. The blow-off charge at the early stage for this developer was −26.5 μC/g. The blow-off charge at the early stage for this developer at low temperature and low humidity (5° C. and 30%) and at high temperature and high humidity (35° C. and 90%) were −26.9 μC/g and −26.3 μC/g, so the developer was very stable.

This developer was used to make images in a commercially available copy machine with a selenium drum. There was no fog, and the reproducibility of fine lines was good; moreover, distinct black images were obtained. The copying properties of this toner did not decline when the toner was used to make 70,000 copies in a row.

EXAMPLE 2

| | |
|---|---|
| Copolymer of styrene and acrylic monomer (Sanyo Kasei Co., HIMER SMB600) | 100 parts |
| Red dye (Orient Chem. Ind., oil pink #312) | 3 parts |
| Compound 2 | 1.2 part |

The above components were treated by the methods in Example 1 to give a red toner, with which developer was made. The blow-off charge at the early stage for this toner was −24.2 μC/g. The blow-off charge at the early stage for this developer at low temperature and low humidity (5° C. and 30%) and at high temperature and high humidity (35° C. and 90%) were −25.1 μC/g and −24.5 μC/g, respectively, so the developer was very stable.

In the same way as in Example 1, the toner was used to make images. There was no fog, and the reproducibility of fine lines was good; moreover, distinct red images were obtained. The copying properties of this toner did not decline when the toner was used to make 70,000 copies in a row.

EXAMPLE 3

| | |
|---|---|
| Copolymer of styrene and n-butylmethacrylate (65/35) | 100 parts |
| Benzidine yellow (C.I. Pigment Yellow 12) | 4 parts |
| Compound 4 | 1 part |

The above mixture was treated by the methods in Example 1 to give a yellow toner, with which developer was made. The blow-off charge at the early stage for this toner was −24.3 μC/g. The blow-off charge at the early stage for this developer at low temperature and low humidity (5° C. and 30%) and at high temperature and high humidity (35° C. and 90%) were −24.0 μC/g and −23.7 μC/g, respectively, so the developer was very stable.

In the same way as in Example 1, the toner was used to make images. There was no fog, and distinct yellow images were obtained. The copying properties of this toner did not decline when the toner was used to make 70,000 copies in a row.

EXAMPLE 4

| | |
|---|---|
| Polyester (Nippon Gosei Kagaku Co.,) | 100 parts |
| Blue dye (Orient Chem. Indust., oil blue #603) | 2 parts |
| Compound 25 | 1 part |

The above mixture was treated by the methods in Example 1 to give a blue toner, with which developer was made. The blow-off charge at the early stage for this toner was −22.9 μC/g. The blow-off charge at the early stage for this developer at low temperature and low humidity (5° C. and 30%) and at high temperature and high humidity (35° C. and 90%) were −22.9 μC/g and −21.2 μC/g, so the developer was very stable.

In the same way as in Example 1, the toner was used to make images. There was no fog, and the reproducibility of fine lines was good; moreover, distinct blue images were obtained. The copying properties of this toner did not decline when the toner was used to make 70,000 copies in a row.

EXAMPLE 5

| | |
|---|---|
| Copolymer of styrene and 2-ethylhexylmethacrylate (80/20) | 100 parts |
| Triiron tetraoxide (Toda Ind., EPT-500) | 40 parts |
| Low-molecular-weight polypropylene (Sanyo kasei Co., Biscol 500P) | 4 parts |
| Carbon black (Mitsubishi Kasei Co., MA-100) | 6 parts |
| Compound 24 | 1 part |

The above components were first mixed to uniformity in a ball mill, and a premix was obtained. Next, the mixture was melted in a twin-screw extruder (Ikegai Seisaku Co., PCM-30), kneaded at 180° C., cooled, pulverized, powdered, and classified, giving a one-component toner with particle diameters of 5–15 μm. Then 2 parts of this toner and 98 parts of iron-powder carrier (Nippon Teppun Co., TEFV 200/300) were mixed and the blow-off charge was measured and found to be $-21.7\ \mu C/g$.

This toner was used in a commercially available copying machine (Canon NP-201) to make toner images. There was no fog, and the reproducibility of fine lines was good. Also, the solid-area reflecting concentration was 1.4, so the images obtained were clear.

Comparative Example

To compare the electrification properties of toner, the compound 1 used in Example 1 was replaced with the 2,6-di-tert-butyl-p-cresol or the 2,2'-methylene-bis-(4-ethyl-6-tert-butylphenol) disclosed in Japanese Laid-Open Patent Publication No. 63-266462, and a toner for comparison was made by the methods of Example 1. Then 5 parts of these toners was mixed with 95 parts of iron-powder carrier (Nippon Teppun Co., TEFV 200/300), resulting in developers or comparison, and the blow-off charge for each developer was measured. These were $-1.1\ \mu C/g$ with 2,6-di-tert-butyl-p-cresol and $-2.7\ \mu C/g$ with 2,2'-methylene-bis-(4-ethyl-6-tert-butylphenol).

Compared to the toner of this invention that contains calix (n) arene compounds as charge-control agents, the toners for comparison had slower electrostatic charging rate at an early stage, and the amount of charged electricity of the toner was less than 1/10 as much.

The toner of this invention that contains the calix (n) arene compound as a charge-control agent has, as is described above in the examples, stability against environmental changes and excellent stability on storage; in addition, it can be used to form images that are clear, the fine lines of which have good reproducibility. Moreover, the calix (n) arene compound of this invention is substantially colorless, with transparency, and compatible with resin binder, so that it can be used to make color toners with transparency. Thus, even when images of colored yellow, magenta, cyan, etc., are overlaid on each other, a clear color image can be obtained.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A toner for use in the development of electrostatic latent images that contains at least one calix (n) arene compound with the general formula represented by the following general formula:

[I]

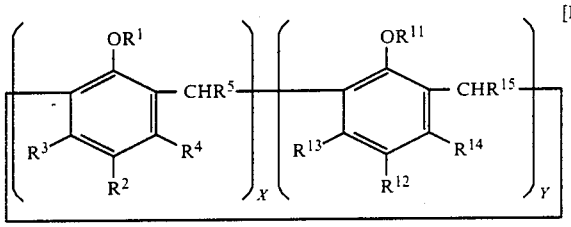

wherein $n=X+Y$; X and Y are integers, and $n=4$ to 8; $R^1$ is a hydrogen atom or an alkyl group with 1-5 carbons or else $-(CH_2)_mCOOR^{10}$ (where $R^{10}$ is a hydrogen atom or a lower alkyl group, and m is an integer from 1 to 3); $R^2$ is a hydrogen atom, halogen atom, alkyl group with 1-12 carbons (which can be in the form of branched chains), aralkyl group, $-NO_2$, $-NH_2$, $-N(R^7)_2$ (where $R^7$ is a lower alkyl group), $-SO_3R^8$ (where $R^8$ is a hydrogen atom), phenyl group (which may be a substituted group), or $-Si(CH_3)_3$; $R^3$ and $R^4$ are independently a hydrogen atom, halogen atom, alkyl group with 1-3 carbons, $-NH_2$, or $-N(R^9)_2$ (where $R^9$ is a lower alkyl group); $R^5$ is a hydrogen atom or an alkyl group with 1-3 carbons; $R^{11}$ is a hydrogen atom, an alkyl group with 1-5 carbons, or $-(CH_2)_pCOOR^{20}$ (where $R^{20}$ is a hydrogen atom or a lower alkyl group, and p is an integer from 1 to 3); $R^{12}$ is a hydrogen atom, halogen atom, alkyl group with 1-12 carbons (which can be in the form of branched chains), aralkyl group, $-NO_2$, $-NH_2$, $-N(R^{17})_2$ (where $R^{17}$ is a lower alkyl group), $-SO_3R^{18}$ (where $R^{18}$ is a hydrogen atom), phenyl group (which may be a substituted group), or $-Si(CH_3)_3$; $R^{13}$ and $R^{14}$ are independently a hydrogen atom, halogen atom, alkyl group with 1-3 carbons, $-NH_2$, or $-N(R^{19})_2$ (where $R^{19}$ is a lower alkyl group; and $R^{15}$ is a hydrogen atom or an alkyl group with 1 to 3 carbons.

2. A toner according to claim 1 wherein 0.1-10 parts by weight of the calix (n) arene compounds represented by general formula I is used per 100 parts by weight of resin.

* * * * *